United States Patent [19]

Quarberg

[11] Patent Number: 5,064,232

[45] Date of Patent: Nov. 12, 1991

[54] ENTRY DOOR SECURITY BAR

[76] Inventor: Craig D. Quarberg, 6908 Candlewood Cir., Brooklyn Park, Minn. 55445

[21] Appl. No.: 674,083

[22] Filed: Mar. 25, 1991

[51] Int. Cl.[5] ..... E05C 17/54

[52] U.S. Cl. ..... 292/339

[58] Field of Search ..... 292/338, 339, 262, 343, 292/259, DIG. 2; 70/94

[56] References Cited

U.S. PATENT DOCUMENTS

| | | | |
|---|---|---|---|
| 1,631,980 | 6/1927 | Piccirilli | 292/338 |
| 3,328,065 | 6/1967 | Arenson | 292/343 |
| 4,483,558 | 11/1984 | Van Meter | 292/339 |
| 4,563,027 | 1/1986 | Chechovsky et al. | 292/339 |
| 4,676,536 | 6/1987 | Arbic et al. | 292/339 |
| 4,883,297 | 11/1989 | Smith | 292/339 |
| 4,971,374 | 11/1990 | Lovell et al. | 292/339 |

*Primary Examiner*—Richard E. Moore
*Attorney, Agent, or Firm*—Haugen and Nikolai

[57] ABSTRACT

A security bar for preventing uninvited opening of a building door comprising an elongated tubular pole which may be formed from telescoping segments and which has a footpad secured to the lower end thereof and a specially designed head member affixed to the opposite end, the head member having an angled face such that when the plane of that face abuts the planar surface of a door, the pole will be at a predetermined angle to the horizontal. The head also includes an arcuate recess formed inwardly from its top surface for cooperating with a door knob of the lockset used with the door. When the head member straddles the door knob with the angled face thereof resting against the door surface, the pole extends at an angle to the floor acting as a brace to prevent the door from being opened against the device.

10 Claims, 1 Drawing Sheet

ENTRY DOOR SECURITY BAR

BACKGROUND OF THE INVENTION

Field of the Invention

This invention relates generally to building security devices, and more particularly to a portable bar arrangement especially designed to prevent a door from being forced open.

II. Discussion of the Prior Art

The crime of breaking and entering has been of increasing concern over the past 20 years due, in part, to the rise in illegal drug usage. Individuals have resorted in increasing numbers to home and business burglary to obtain money or items of personal property that can be sold to raise money with which to purchase drugs. Accompanying this increase is also an increase in violent crimes against persons. Many individuals no longer feel safe in their own homes or in commercial establishments, such as hotels and motels.

A common mode of entry involves kicking in the building's entry door. In most cases, the conventional locksets used on such entry doors have a key-operated bolt which is too short relative to its depth of penetration into an adjacent door jam to resist the force of an adult kicking in the door or lunging at the door with his shoulder. Wooden jams merely crack and shatter with relatively little effort.

Various other devices have been used with doors to make forced entry more difficult. Slide bolts and chains have been used but a determined intruder with readily available tools, such as pry bars and bolt cutters, are able to defeat those measures as well.

Conventional entry door locksets may also be defeated with a simple plastic credit card which, if slipped between the door and its jam proximate the spring-loaded bolt of the lockset, the bolt can be made to retract out of the jam and the door opened.

SUMMARY OF THE INVENTION

The present invention is intended to reduce the possibility of forced entry into a building. In its simplest form, it comprises an elongated pole having upper and lower ends. A footpad is connected by a ball-joint swivel mechanism to the lower end of the pole and a specially designed head member is secured to the upper end of the pole. The head member comprises a block made from metal, plastic or wood which has one face thereof defining a planar surface that is oriented at a predetermined angle to the longitudinal axis of the pole member. Also formed in the block is an arcuate groove of generally semicircular cross-section. The longitudinal axis of this groove intersects the angled planar surface at substantially a right angle, the groove being dimensioned for receiving a door knob therein when the angled planar surface is positioned flat against the door and the footpad rests on the floor a predetermined distance away from the door surface. When the pole is at an angle of about 60° to the floor, the force vector resulting when someone pushes against the door has a major component directed downward which prevents the footpad from sliding along the floor.

The angled planar surface of the head portion has a non-abrasive covering to prevent scratching or marring of the door surface by the security bar. Further, the head portion preferably also includes an arcuate recess formed inwardly of the door abutting face for receiving the escutcheon that normally surrounds a door knob.

By making the pole out of two telescoping tube segments, the device can be collapsed to a sufficiently small size to permit it to be conveniently carried in a suitcase by travelers for use in hotels and the like.

DESCRIPTION OF THE DRAWINGS

The foregoing objects, advantages and features of the invention will become apparent to those skilled in the art from the following detailed description of a preferred embodiment, especially when considered in conjunction with the accompanying drawings in which like numerals in the several views refer to corresponding parts.

FIG. 3 is a top view of the device of FIG. 1;

FIG. 4 is a partial view of the footpad of FIG. 1 but designed for use on carpeting.

DESCRIPTION OF THE PREFERRED EMBODIMENT

Figure 1:
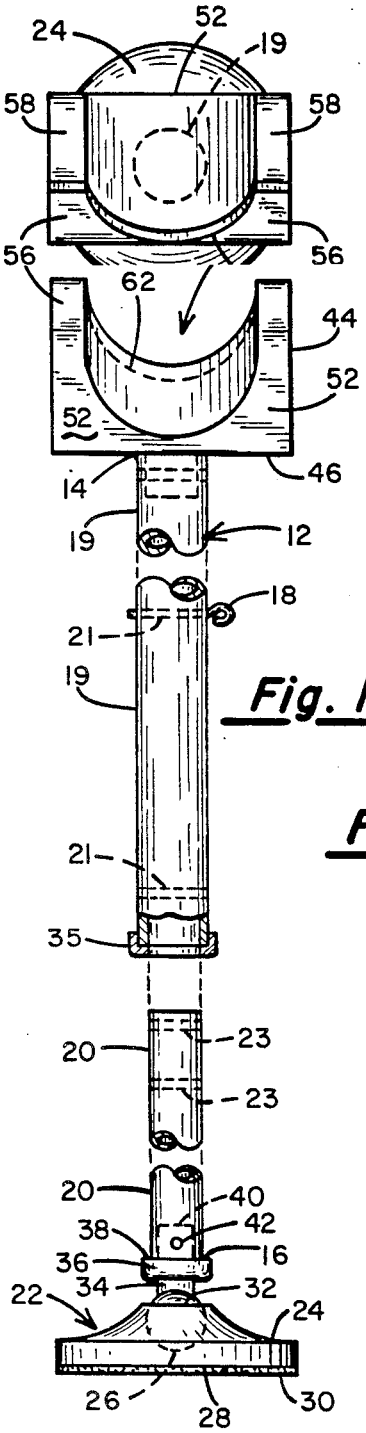
FIG. 1 is a front elevation view of the security bar comprising the preferred embodiment of the present invention.

Referring first to FIG. 1, there is indicated generally by numeral 10 a security device for barring entry into a room through its door. The device comprises an elongated pole member 12 having an upper end 14 and a lower end 16. The pole 12 may be solid or, for weight considerations, may be tubular. Preferably the pole 12 may comprise first and second aluminum tubes of generally equal length where the internal diameter of the first tube and the external diameter of the second tube are such that the second tube can telescopingly fit within the interior of the first tube. In this way, the device can be collapsed into a more compact length for ease of transportation in a suitcase or the like. When in use, however, the unit will be extended until apertures formed through the walls of each of the tubes are aligned to allow a pin, as at 18, to be inserted through the aligned apertures, thus locking the pieces in their extended disposition. To provide additional reinforcing, it is also contemplated that a solid aluminum plug be swaged into the upper portion of the lower tube segment 20 and that the hole for the pin 18 pass through a bore formed through the plug in alignment with the holes drilled through the walls of the lower tube. This will prevent the metal of the tube from tearing under heavy load.

Affixed to the lower end 16 of the pole 12 is a footpad member indicated generally by numeral 22. It comprises a molded plastic base 24 having a spherical socket 26 formed in an upper surface 28 thereof and a generally planar base 28 to which is affixed an elastomeric non-slip circular pad 30 for use on bare floors. As shown in FIG. 4, where the area of use is carpeted, it has been found expedient to replace the pad 30 with a surface having a plurality of integrally molded spikes for engaging the carpet fibers. Also forming a part of the footpad member is a spherical ball 32 dimensioned to fit within the socket 26 but be retained by virtue of the fact that the top surface 28 defining the socket is of a lesser circular dimension than the major diameter of the spherical member 32. The spherical member 32 is integrally molded on the end of a cylindrical sleeve 34 and a flange 36 projects radially outward from the stem 34 to define a shoulder 38 against which the lower end 16 of the tube segment 20 may rest. Projecting upward from the flange 38 and dimensioned to fit within the central opening of the tube 20 is a further stem 40. A roll pin 42 may be used to secure the tube 20 and the stem 40 together.

By virtue of the spherical member 32 fitting into a spherical recess in the base member 24, the base member 24 is free to swivel or pivot about the ball 32. As such, the pole 12 can be positioned at an angle to the floor while the elastomeric pad 30 or the spiked pad rests flat on the floor or carpeting, respectively.

Affixed to the upper end 14 of the segment 19 of the telescoping pole 12 is a head member 44. When considering FIGS. 1, 2 and 3 together, it can be seen that the head member generally comprises a block having a planar base 46 having an integrally formed cylindrical post 48 projecting downwardly therefrom into the central opening of the tube segment 19. Again, a roll pin as at 50 passing through a hole in the wall of the tube 19 and into the stem 48 can be used to lock those two pieces together to prevent the head 44 from being pulled free from the tube segment 19.

Figure 2:
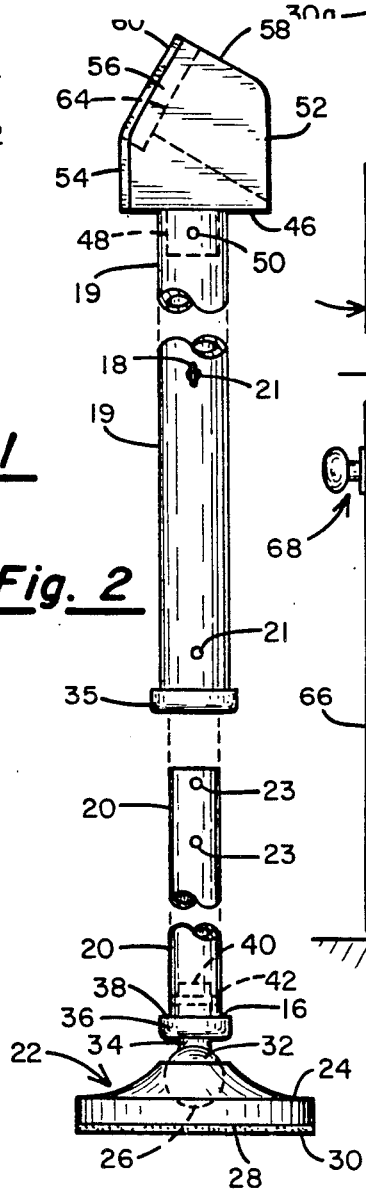
FIG. 2 is a side elevation of the device of FIG. 1.

The head member 44 includes a vertical front face 52 which projects upward for a predetermined distance before sloping upward and to the left when viewed as in FIG. 2. The rear face of the block 44 includes a first section 54 which is generally perpendicular to the base 46 but then the rear face angles upward and to the right as at 56 until it intersects with the upwardly sloping surface 58.

The surfaces 54 and 56 are preferably covered with a non-abrasive material, such as an elastomeric pad 60 to prevent scratching of the door surface when put in place and removed.

FIGS. 1 and 3 reveal an arcuate recess 62 formed through the head member 44. The recess 62 is generally semi-circular and it is formed at generally a right angle with respect to the inclined surface 56 comprising the rear face of the head member. A further arcuate recess 64 is formed inwardly into the surface 56.

The head member 44 may be formed from a variety of materials but when manufacturing cost, strength and weight are taken into account, it is preferably formed from a suitable plastic, such a Delron TM plastic.

The angle of inclination of the face 56 relative to the center line of the pole 12 is such that they intersect at an angle in the range of from 25° to 45°, but with an angle of 30° being perhaps preferred. This places the pole at an angle of 60° to the floor when in use.

Figure 5:
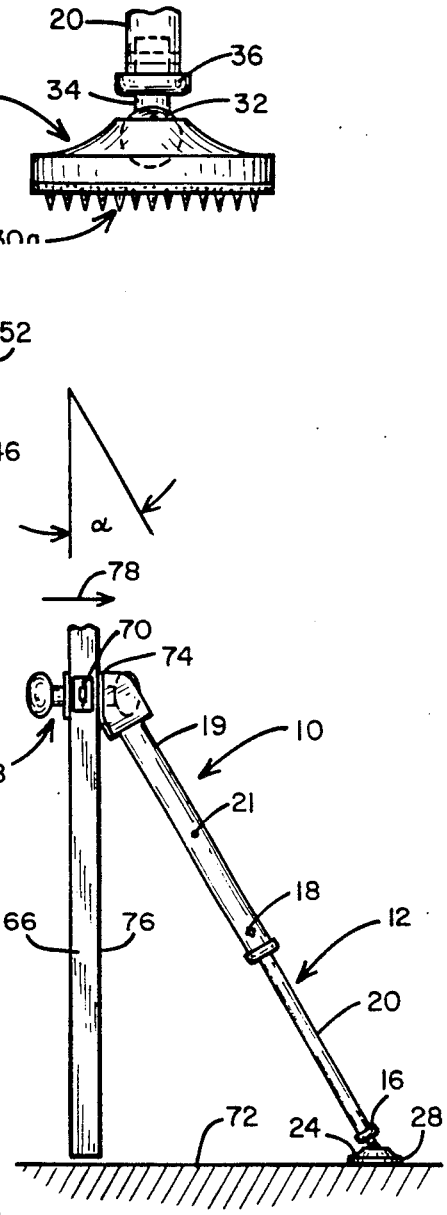
FIG. 5 is a view showing the manner in which the security bar of FIG. 1 is used to prevent forced entry through a room door.

Referring next to FIG. 5, the manner in which the security bar 10 of the present invention is used will be explained. In FIG. 5, there is shown a portion of an entry door 66 in which is installed a lockset indicated generally by numeral 68. The lockset includes a pair of knobs on opposite side surfaces of the door 66, the knobs being coupled to a shaft (not shown) which cooperates with a bolt as at 70. By turning the knob, the bolt can be retracted free of a socket formed in the adjacent door jam. The floor of the building is identified by numeral 72.

The security bar is installed by first extending the two telescoping pole segments 19 and 20 and locking them together by the pin 18, all as previously described. The arcuate recess 64 formed in the face 56 of the head 44 is made to surround the escutcheon 74 which surrounds the shaft of the knob and covers the working parts of the lockset and the hole in the door in which the lockset is received. When the escutcheon is so disposed in the arcuate groove 64 formed in the head 44, the inclined surface 56, and especially the non-abrasive pad 60 thereon, rests flat against the side surface 76 of the door. Now, by pushing down on the lower end 16 of the pole 12, the footpad 24 will swivel until its base 28 rests flat on the floor 72.

If an effort is made to swing the door in the direction shown by the arrow 78, the harder that the door is pushed, the greater the force that is directed down the pole member 12 to hold the footpad 24 against the floor, thus preventing the footpad from sliding on the floor. As mentioned, if the floor covering in front of the door is carpeting, the footpad preferably has a spiked base as in FIG. 4 for preventing movement of the base on the carpet.

In that a generally world-wide standard exists for the height of the lockset above the floor, it is possible to utilize a pole member of a constant length while still maintaining the desired 60° angle between the base of the pole and the floor.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. A security device for barring forced entry into a room through a door, the door having a lockset with a knob and an escutcheon surrounding said knob, said device comprising:

(a) a pole member having upper and lower ends;

(b) a foot member secured to the lower end of said pole member;

(c) a head member secured to the upper end of said pole member, said head member including (i) a block having one face thereof defining a planar surface oriented at a predetermined angle to the longitudinal axis of aid pole member with an arcuate recess formed inwardly of said one face for receiving said escutcheon therein, and (ii) an arcuate groove of semicircular cross-section formed in said block and intersecting said planar surface at a right angle for receiving said knob therein when said planar surface buts said door and said foot member abuts the floor of said room.

2. The security device as in claim 1 wherein said foot member swivels on the lower end of said pole member.

3. The security device as in claim 1 wherein said planar surface includes a non-abrasive covering.

4. The security device as in claim 1 wherein said predetermined angle is in the range of from 20° to 44°.

5. The security device as in claim 1 wherein said predetermined is about 30°.

6. The security device as in claim 1 wherein said pole member comprises first and second tubular telescoping segments and means for locking said segments relative to one another at a predetermined composite length.

7. The security device as in claim 1 wherein said pole member is a tube and said head member includes a cylindrical stem for fitting into said upper end of said pole member.

8. The security device as in claim 1 wherein said foot member includes a non-skid floor engaging surface.

9. The security door as in claim 8 wherein said non-skid surface is an elastomeric pad.

10. The security device as in claim 8 wherein said non-skid surface includes a plurality of spikes projecting downwardly for penetrating the surface of carpeting.

* * * * *

UNITED STATES PATENT AND TRADEMARK OFFICE

CERTIFICATE OF CORRECTION

PATENT NO. : 5,064,232

DATED : November 12, 1991

INVENTOR(S) : Craig D. Quarberg

It is certified that error appears in the above-identified patent and that said Letters Patent is hereby corrected as shown below:

Column 4, line 47, "aid" should be -- said --.

Column 4, line 62, "44" should be --45--.

Column 4, line 64, after "predetermined" insert --angle--.

Signed and Sealed this

Ninth Day of March, 1993

*Attest:*

STEPHEN G. KUNIN

*Attesting Officer*

*Acting Commissioner of Patents and Trademarks*